United States Patent [19]

Nicodemus

[11] 4,037,414

[45] July 26, 1977

[54] LIQUID/VAPOR ENERGY CYCLE

[76] Inventor: Carl D. Nicodemus, 176 Meigs St., Rochester, N.Y. 14607

[21] Appl. No.: 708,124

[22] Filed: July 23, 1976

[51] Int. Cl.[2] ..... F01K 19/00

[52] U.S. Cl. ..... 60/670; 60/685

[58] Field of Search ..... 60/645, 651, 670, 671, 60/685, 694

[56] References Cited

U.S. PATENT DOCUMENTS 3,788,064 1/1974 Hawkins ..... 60/685 X

*Primary Examiner*—Allen M. Ostrager

*Attorney, Agent, or Firm*—Stonebraker, Shepard & Stephens

[57] ABSTRACT

The invention applies to a liquid/vapor energy cycle having a boiler for heating a liquid to produce a vapor for driving a transducer and a way of returning the transducer output to the boiler. A vortex tube receives the output from the transducer and divides the transducer output into relatively hot and cold portions, and an injector is powered by the vapor and arranged for pumping the cold portion of the transducer output back into the boiler. The hot portion of the transducer output is preferably used for powering the injector, and a portion of the vapor from the boiler can assist in this.

10 Claims, 5 Drawing Figures

LIQUID/VAPOR ENERGY CYCLE

BACKGROUND OF THE INVENTION

The invention occurs as an improvement in liquid/vapor energy cycles where water or some other liquid is heated to produce steam or a corresponding vapor that powers a transducer to extract energy from the sytem. Such cycles usually use a condenser and associated equipment for condensing the vapor output from the transducer and pumping the condensate back into the broiler.

The invention involves appreciation of the usefulness of a vortex tube in such a liquid/vapor energy cycle. Vortex tubes are generally known for dividing room-temperature air into hot and cold portions, with the cold portion used for refrigeration purposes. The capacity of a vortex tube to divide a gas, vapor, or liquid and gas mixture into hot and cold portions is used advantageously in energy cycles for simplicity, effectiveness, and improved thermal efficiency.

SUMMARY OF THE INVENTION

The inventive liquid/vapor energy cycle includes means for heating a liquid in a boiler to produce a vapor driving a transducer. A vortex tube receives and divides the transducer output into relatively hot and cold portions, and an injector powered by the vapor pumps the cold portion of the transducer output into the boiler. Preferably the hot portion of the transducer output powers the injector, and a vortex tube can also be arranged between the boiler and the transducer for dividing the boiler vapor into hot and cold portions and directing the hot portion of the vapor into the transducer. Coolers, pumps, and ejectors can be added to the system to increase efficiency under particular circumstances.

DRAWINGS

FIGS. 1–5 are all schematic views of preferred embodiments of the invention showing possible alternatives.

DETAILED DESCRIPTION

The invention applies to liquid/vapor energy cycles, the most common of which is the water/steam energy cycle, but it also applies to other liquids that can be heated to produce a vapor for driving a transducer, and it is not limited to the water/steam cycle. Butane, propane, and liquids used in refrigeration systems and having lower boiling points than water can be used to advantage in energy cycles according to the invention, because relatively little heat is required to produce vapor. Also, the inventive system is preferably thermally self contained and insulated for maximum efficiency in using the thermal energy applied. The transducer driven by the heated vapor is preferably a turbine, although other vapor-driven transducers are possible, and the invention is not limited to any particular transducer.

The solid-line portions of the drawings show several preferred alternative embodiments of the invention, and the broken-line portions of the drawings show additional alternatives that can be used in particular circumstances. The structures of the different embodiments can be combined in various ways, and the invention is not limited to the illustrated embodiments.

In all the illustrated embodiments, liquid is heated in a boiler 10 to produce a vapor used for driving a turbine or other transducer 11, and a vapor-powered injector 12 pumps condensate back into boiler 10. The differences in the illustrated embodiments involve various arrangements of vortex tubes, different ways of powering the injector 12, and use of accessories, all as described below.

Vortex tubes 15 are used in the inventive energy cycle for dividing the output from transducer 11 into hot and cold portions. Vortex tubes are generally known for driving room-temperatue air in a high-velocity helical path for dividing the input into relatively hot and cold portions, with the cold portion used for cooling, and the hot portion normally exhausted. Since low temperatures are ordinarily desired for cooling purposes, moisture in the input air is avoided.

The invention involves recognition of the possibility of using a vortex tube for dividing the vapor output from transducer 11 into hot and cold portions for effectively condensing a portion of the transducer output and producing a still useable hot portion. The flow rates and volumes are adjusted relative to the size of the vortex tube, so that liquid does not freeze in the vortex tube, and the proportions of the hot and cold portions are adjusted for optimum efficiency.

Figure 1:
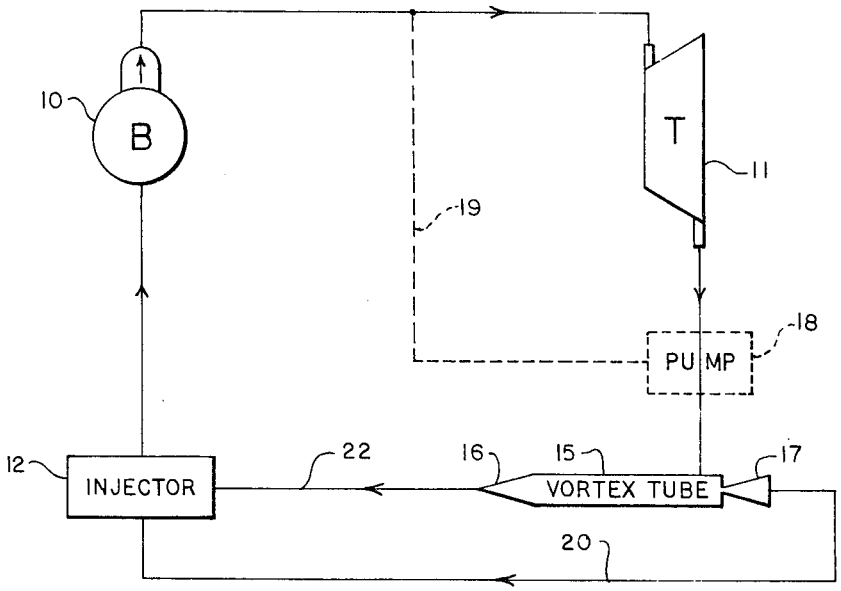

As applied to the illustrated embodiments, a vortex tube 15 receives the output from transducer 11 and divides it into relatively hot and cold portions. The hot portion is output through the schematically pointed end 16 of vortex tube 15, and the cold portion is output through schematically flared end 17 of vortex tube 15. The vapor output from transducer 11 preferably has enough energy for powering vortex tube 15 to achieve the relatively hot and cold outputs, but if additional energy is necessary, a preferably vapor-powered pump 18 is interposed between transducer 11 and vortex tube 15 and powered by heated vapor through line 19 as suggested by broken lines in FIG. 1. Vortex tube 15 consumes some energy in dividing the transducer output into hot and cold portions, and vortex tube 15 generally takes the place of a conventional condenser.

The cold portion of the divided output from transducer 11 is discharged from vortex tube output 17 and conducted through line 20 to the input of injector 12 for return to boiler 10. Vortex tube 15 is preferably sized and powered relative to the flow rate so that the output in line 20 is condensed liquid, but the cold portion of the output of vortex tube 15 can be at least partially vaporous and a cooler 21 can be arranged to cool the fluid in line 20 to form a condensed liquid. However, cooler 21 is preferably not required.

The hot portion of the divided output from transducer 11 is delivered from vortex tube output 16 and conducted through line 22 to provide vapor power for injector 12. The hot vapor in line 22 preferably condenses in the cooler liquid from line 20 inside of injector 12 in the process of pumping condensed liquid back to boiler 10. The energy consumed by injector 12 adds to the energy consumed by vortex tube 15 for providing effective condensation and pumping between the output of transducer 11 and the input to boiler 10.

Figure 3:
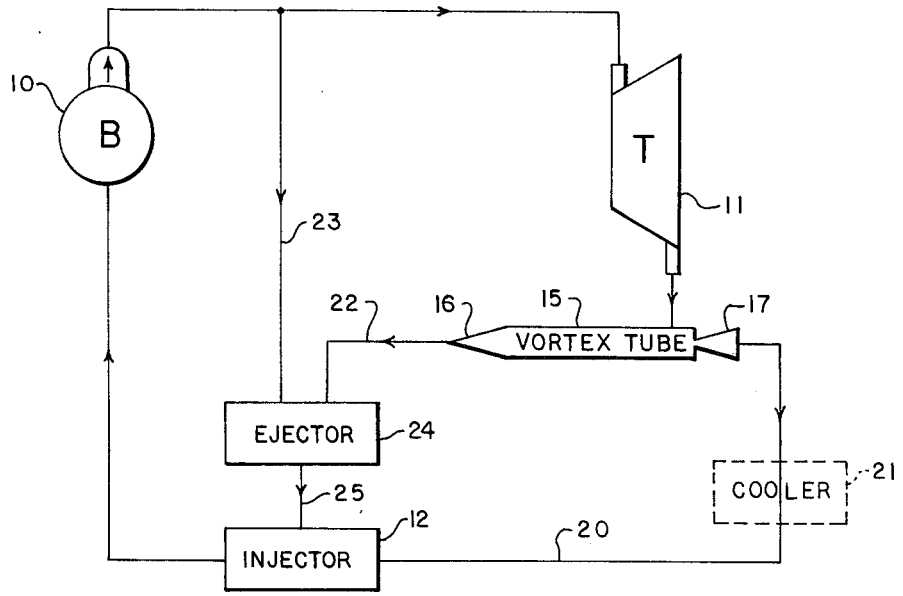
Figure 5:
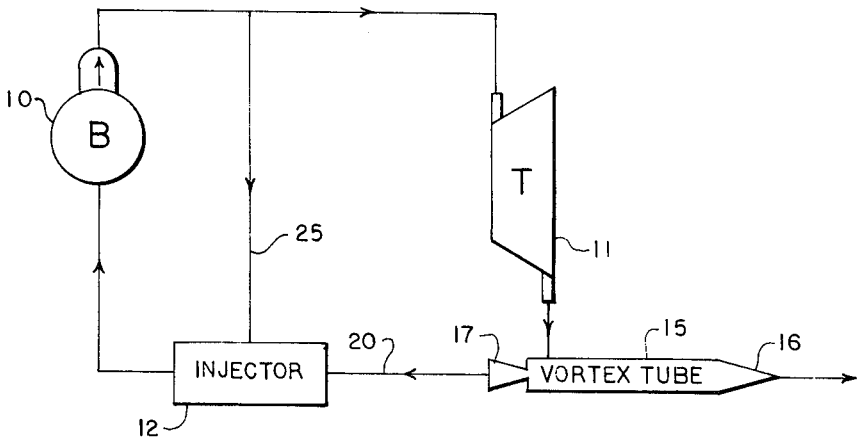

In the embodiment of FIG. 3, the hot vapor output in line 22 from output 16 of vortex tube 15 is combined with hot vapor from boiler 10 via line 23 in an ejector 24 operating as a jet or venturi pump providing a relatively hot or high-energy vapor steam through line 25 for powering injector 12 to pump condensate back to boiler 10. Ejector 24 can have several generally known forms, and its use depends upon other parameters. In the embodiment of FIG. 5, injector 12 is powered directly by hot vapor from boiler 10 via line 25 for pumping condensate from vortex tube output 17 and line 20 back to boiler 10, and the hot portion of the transducer output from vortex tube output 16 is exhausted or used for other purposes.

Figure 2:
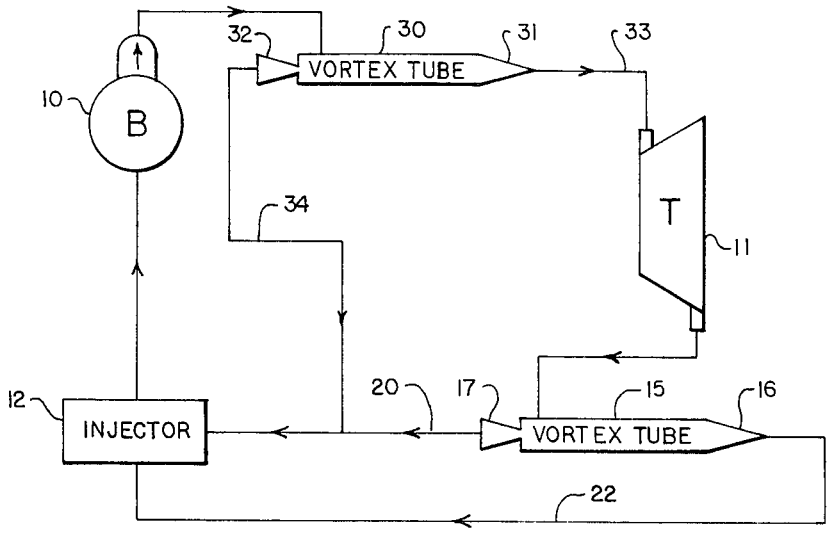
Figure 4:
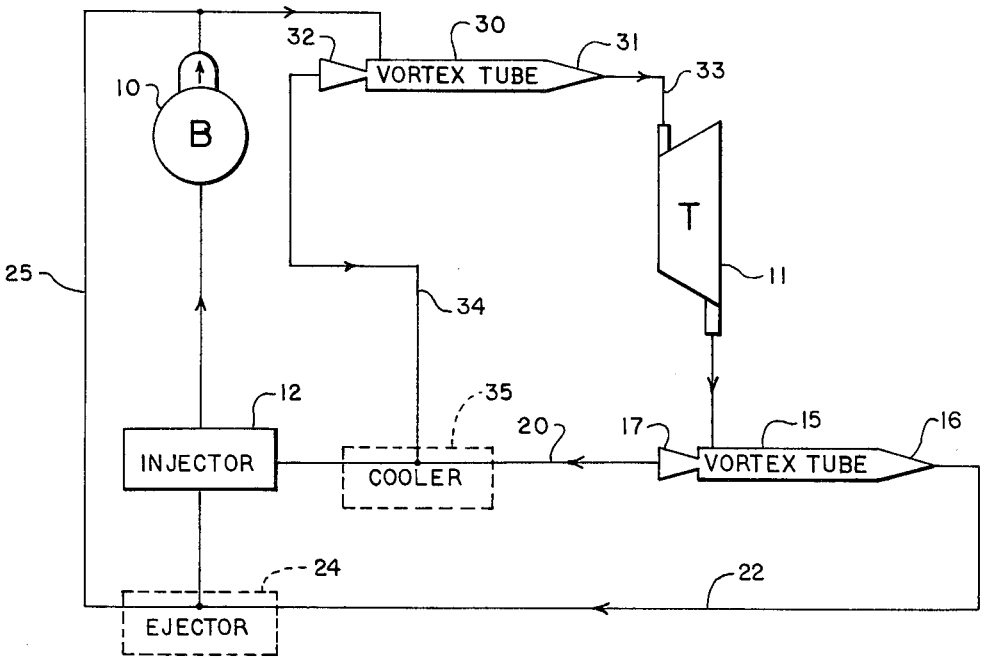

The embodiments of FIGS. 2 and 4 use an additional vortex tube 30 between boiler 10 and transducer 11, and vortex tube 30 divides the boiler vapor into a hot portion output through output end 31 and a cold portion output through output end 32. The hot portion is fed through line 33 to transducer 11 for extracting energy from the system, and the cold portion is directed through line 34 to the input to injector 12, either directly as shown in FIG. 2, or via an optional cooler 35 of FIG. 4. As schematically indicated in FIG. 4, cooler 35 can also cool the cold output from vortex tube output 17, and the cold outputs of vortex tubes 15 and 30 are preferably combined in such a way as to feed a condensate to injector 12 for pumping back to boiler 10. Injector 12 can be powered directly by the hot portion of the output from vortex tube 15 through line 22, or by hot vapor directly from boiler 10 via line 25, or by a combination of hot vapor from vortex tube 15 and hot vapor from boiler 10 combined either directly or via ejector 24 in the form of a jet or venturi pump, all as suggested by the alternatives of FIGS. 2 and 4.

Various parameters of the inventive system must be adjusted or balanced for optimum efficiency as is generally known by those skilled in the art. The hot and cold outputs of the vortex tubes 15 and 30 can be adjustably varied to fit other parameters, and pressures, temperatures, flow rates, and velocities at various points in the system are all preferably adjusted by generally known means in cooperation with the proportioning of the various components so that each component operates relatively efficiently. Different vaporizable liquids can be used, and the entire system can be enclosed, insulated, and powered by different energy or heat sources. Once the operating principles of the inventive arrangement of components are clearly understood, those skilled in energy cycle systems will understand how to make the appropriate adjustments to achieve operating efficiency.

I claim:

1. In a liquid/vapor energy cycle including means for heating a said liquid in a boiler to produce said vapor and a transducer driven by said vapor, the improvement comprising:

a. a vortex tube arranged for receiving the output from said transducer and dividing said transducer output into relatively hot and cold portions; and b. an injector powered by said vapor and arranged for pumping said cold portion into said boiler.

2. The improvement of claim 1 wherein said vapor for powering said injector comprises said hot portion of said transducer output.

3. The improvement of claim 2 wherein said vapor for powering said injector includes a portion of said vapor from said boiler.

4. The improvement of claim 1 including a cooler for cooling said cold portion.

5. The improvement of claim 1 including a pump for increasing the pressure of said transducer output fed to said vortex tube.

6. The improvement of claim 1 including another vortex tube arranged for receiving said vapor from said boiler, dividing said boiler vapor into relatively hot and cold portions, and directing said hot portion of said boiler vapor to said transducer.

7. The improvement of claim 6 wherein said injector is arranged for pumping said cold portion of said boiler vapor into said boiler.

8. The improvement of claim 7 including a cooler for cooling the input to said injector.

9. The improvement of claim 6 wherein said vapor for powering said injector comprises said hot portion of said transducer output.

10. The improvement of claim 9 wherein said vapor for powering said injector includes a portion of said vapor from said boiler.

* * * * *